US006149406A

United States Patent [19]

Chang

[11] Patent Number: 6,149,406

[45] Date of Patent: Nov. 21, 2000

[54] HEAT DISSIPATING FAN FOR AN INDUCTION MOTOR

[76] Inventor: Chin-Chin Chang, No. 122, Lane 967, San Feng Road, Feng Yuan Taichung Hsien, Taiwan

[21] Appl. No.: 09/390,750

[22] Filed: Sep. 7, 1999

[51] Int. Cl.[7] ..... F04B 17/00

[52] U.S. Cl. ..... 417/423.1; 416/224

[58] Field of Search ..... 417/423.1, 224, 417/423.15, 423.14, 415, 368, 423.7; 134/57 D, 56 D, 58 D; 416/224 R

[56] References Cited

U.S. PATENT DOCUMENTS

| | | | |
|---|---|---|---|
| 3,557,772 | 1/1971 | Kofink | 126/110 |
| 4,065,233 | 12/1977 | Torigoe et al. | 417/368 |
| 5,156,535 | 10/1992 | Budris et al. | 417/423.7 |
| 5,378,124 | 1/1995 | Welch | 417/423.1 |
| 5,741,124 | 4/1998 | Mazzucato et al. | 417/415 |
| 5,814,908 | 9/1998 | Muszynski . | |
| 5,971,725 | 10/1999 | de Simon et al. | 417/423.8 |
| 5,996,685 | 12/1999 | Alizadeh | 165/121 |

*Primary Examiner*—Teresa Walberg
*Assistant Examiner*—Jeffrey Pwu
*Attorney, Agent, or Firm*—Connolly Bove Lodge & Hutz

[57] ABSTRACT

A heat dissipating fan for an induction motor comprises a motor shaft with a circular groove and an end part. A fan has blades and a hollow central shaft with a hole, and tennons are provided on an inner wall of the hole for fitting with the circular groove. A protection cover has an opening being passed through by the motor shaft. Furthermore, heat releasing fins are provided on the protection cover and space apart with each other surrounding the opening. The fan is characterized by that the blades is attached to the fan and is fixed to an annular base plate. The base plate has a slanted curvy surface structure. When said fan is rotating synchronously with said motor shaft, the air current can be directed smoothly and backwards into the motor.

1 Claim, 3 Drawing Sheets

HEAT DISSIPATING FAN FOR AN INDUCTION MOTOR

BACKGROUND OF THE INVENTION

1. Field of the Invention

The present invention relates to a fan in an induction motor for dissipating heat generated in the motor.

2. Description of Related Art

When a motor is rotating at a high speed, a huge amount of heat is generated. In order to dissipate the heat and cool down the wire coils thereof, usually a fan is provided to rotate with the motor shaft synchronously for cooling purpose. In a prior art as shown in FIGS. 1 and 2, a fan (3) is attached onto a motor shaft (2) in an induction motor (1). Although the rotating fan is able to direct heat-dissipating air currents into a motor cover shield (6), it is unable to cool the motor effectively. It is because the blades of the fan (3) are connected perpendicularly to the motor shaft (2) and directly onto an annular base plate (4). Therefore, the air current in the conventional induction motor can only be directed straightforward to the walls of the cover shield (6) (as shown in FIG. 1). Thus, a turbulent phenomenon occurs and it results in that the cooling air is unable to flow directly onto the main wire coils in the motor (1). This effect significantly reduces the heat dissipation and cooling of the motor. Therefore it is shown that the prior art of the heat dissipation and cooling system cannot effectively lower the temperature of the motor and might result in lowering of the motor performance and shorting of the motor life.

SUMMARY OF THE INVENTION

The main objective of the present invention is to provide an induction motor with an improved heat dissipating fan structure. The structure comprises a circular groove provided on the induction motor shaft, several tenons which are located at the inner wall of a central hollow shaft on the fan respectively for fitting with the groove to allow the fan rotating smoothly and synchronously with the motor shaft, and a protection cover with heat releasing fins which is passed through by an end part of the motor shaft. The characteristic of the invention resides in that the fan is provided with blades vertically attaching to a hollow base plate thereof and the plate has a slanted curvy surface structure to allow the air current directing smoothly and backwards onto the bottom part of the wire coils in the motor during the fan is rotating. In addition, the advantage of the invention can increase both the speed and volume of the heat-dissipating currents directed into the motor such that it is then able to reduce the high temperature of the motor significantly. Therefore, a better performance and a longer life of the motor can achieve easily.

BRIEF DESCRIPTION OF THE DRAWING

The structure and characteristic of the present invention can be more fully understood by reference to the following description and accompanying drawings, in which.

DETAILED DESCRIPTION OF THE PREFERRED EMBODIMENT

Figure 1:
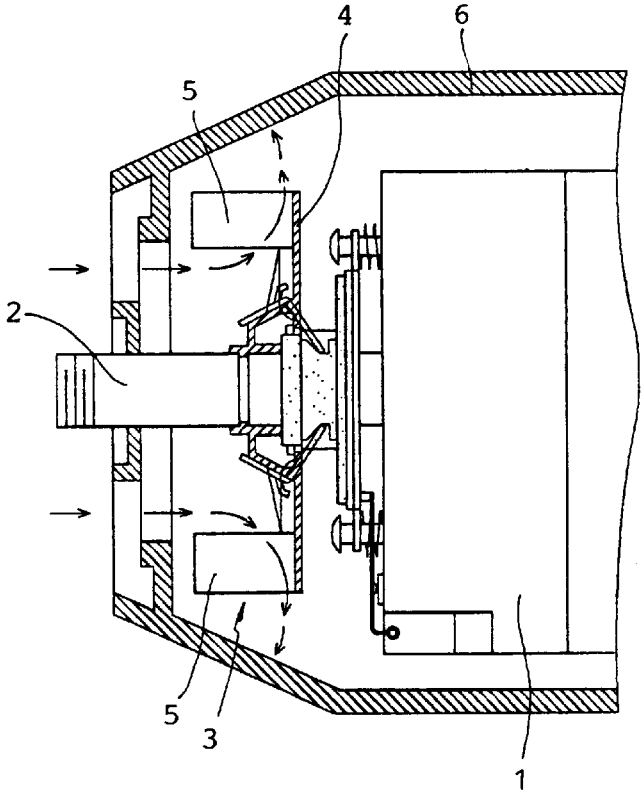
FIG. 1 ( PRIOR ART )
FIG. 1 is a sectional plan view of a conventional induction motor at an end part thereof, illustrating the path of the air flows created by a heat-dissipating fan.
Figure 2:
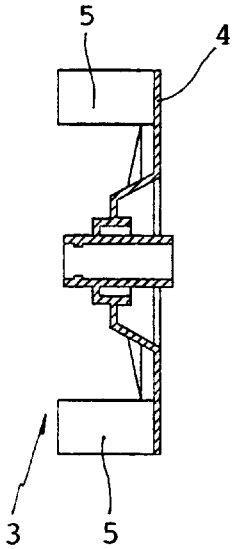
FIG. 2 ( PRIOR ART )
FIG. 2 is a cross-section view of the fan shown in FIG. 1.
Figure 3:
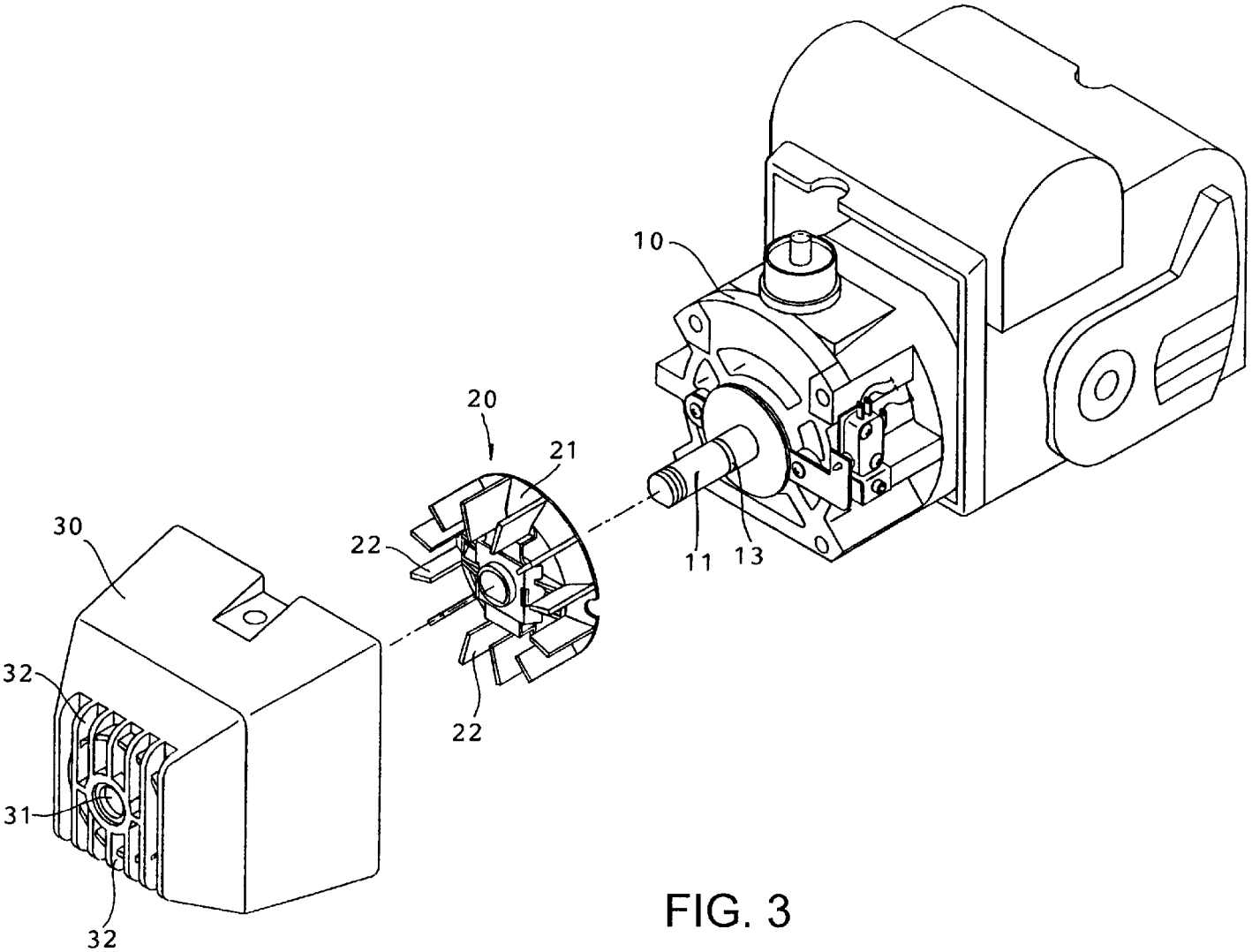
FIG. 3 is a perspective view of an induction motor of an embodiment in the present invention showing a disassembled fan and a disassembled cover.
Figure 4:
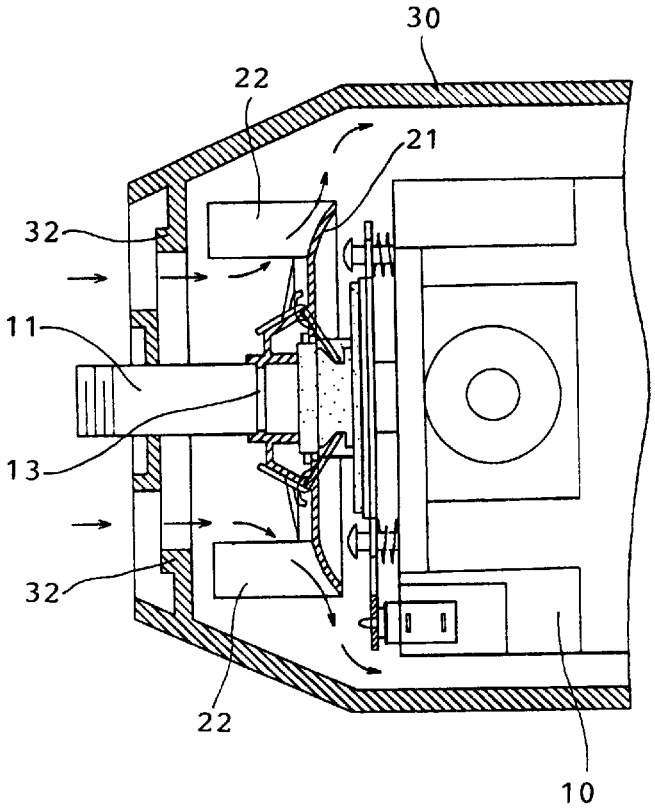
FIG. 4 is a sectional plan view of the induction motor of FIG. 3 with the fan and the cover assembled, showing the path of the air flows created by the fan.
Figure 5:
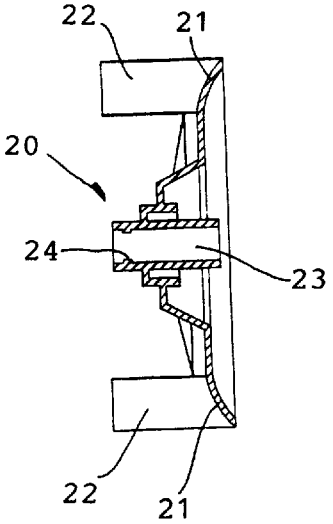
FIG. 5 is a cross-section plan view of the fan shown in FIG. 4.

Please refer to FIGS. 3 to 5 for the improved heat dissipating fan structure of the present invention. First, a circular groove (13) is provided on the motor shaft (11) of an induction motor (10). A fan (20), with several blades (23), is fitted with the groove (13). In the hollow shaft of this fan (20) is provided with a central hole (23), and there are several tenons (24) on the inner wall respectively corresponding with one and another. These tendons (24) allow the fan (20) fixedly to fit with the groove (13) when the shaft (11) is inserted into the central hole (23). Thus, the fan (20) is able to rotate synchronously with the motor shaft (11). An end part of this motor shaft (11) is then protruded out of the cover shield (30) via the circular opening (31). On the cover shield (30), there are provided with heat releasing fins (32) spacing apart with each other surround the opening (31). The main characteristic of the present invention is that the blades (22) on the fan (20) are vertically attached to an annular base plate (21) and the bottom of the base plate (21) has a slanted curvy surface structure. This allows the heat-dissipating currents to be smoothly directed backwards and toward the bottom of induction coils in the motor while the fan (20) is rotating. In addition, the slanted curvy surface of the base plate (21) increases both the speed and volume of the air current directed into the motor. Thus it is then able to reduce the high temperature of the motor significantly. Furthermore, this results in an increase in the motor performance and also prolongs the motor's life.

While the invention has been described with reference to a preferred embodiment thereof, it is to be understood that modifications and variations may be easily made without departing from the spirit of this invention which is defined by the appended claim.

What is claimed is:

1. A heat dissipating fan for an induction motor, comprising:

a motor shaft with a circular groove and an end part;

a fan, having a plurality of blades and having a hollow central shaft with a hole, a plurality of tennons being provided on an inner wall of said hole for fitting with said circular groove;

a protection cover, having an opening being passed through by said end part, and having a plurality of heat releasing fins spacing apart with each other surrounding said opening;

characterized by that said blades being attached to said fan vertically and being fixed to an annular base plate; said base plate having a slanted curvy surface structure;

whereby, when said fan is rotating synchronously with said motor shaft, the air current can be directed smoothly and backwards into said motor.

* * * * *